US009761980B2

(12) United States Patent
Zeng et al.

(10) Patent No.: US 9,761,980 B2
(45) Date of Patent: Sep. 12, 2017

(54) BATTERY CONNECTOR AND MANUFACTURING METHOD THEREFOR

(71) Applicant: Nokia Technologies Oy, Espoo (FI)

(72) Inventors: Xianlong Zeng, Beijing (CN); Xuewu Zhao, Beijing (CN); Ming Zhong, Beijing (CN)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 14/912,120

(22) PCT Filed: Sep. 9, 2013

(86) PCT No.: PCT/CN2013/083150
§ 371 (c)(1),
(2) Date: Feb. 15, 2016

(87) PCT Pub. No.: WO2015/032098
PCT Pub. Date: Mar. 12, 2015

(65) Prior Publication Data
US 2016/0197427 A1 Jul. 7, 2016

(51) Int. Cl.
*H01R 4/48* (2006.01)
*H01R 13/24* (2006.01)
(Continued)

(52) U.S. Cl.
CPC ..... *H01R 13/2407* (2013.01); *H01R 13/035* (2013.01); *H01R 13/2428* (2013.01);
(Continued)

(58) Field of Classification Search
CPC ... H01R 13/17; H01R 13/187; H01R 13/2442
(Continued)

(56) References Cited

U.S. PATENT DOCUMENTS 7,775,805 B2 * 8/2010 Liao ..... H01R 13/2435 439/66
7,785,150 B1 8/2010 Ho
(Continued)

FOREIGN PATENT DOCUMENTS

CN 200941463 8/2007
CN 101212096 7/2008
(Continued)

OTHER PUBLICATIONS

International Search Report and Written Opinion received for corresponding Patent Cooperation Treaty Application No. PCT/CN2013/083150 , dated Jun. 5, 2014, 13 pages.
(Continued)

*Primary Examiner* — Phuong Dinh
(74) *Attorney, Agent, or Firm* — Nokia Technologies Oy

(57) ABSTRACT

A connector comprises an insulating housing (10) defining a plurality of isolated terminal chambers and a plurality of conductive terminals (20) disposed in respective terminal chambers of the insulating housing. Each of the terminal chambers has a bottom portion (101) on one side of the insulating housing and an opening (102) through a surface (103) on the opposite side of the insulating housing. Each of the conductive terminals comprises a fixing portion (201) that is fixed on the bottom portion of a corresponding terminal chamber, a contact portion (203) that is projecting out of the opening, and a middle portion (202) that is connected between the fixing portion and the contact portion and slanting from one end of the fixing portion towards the other end of the fixing portion. The middle portion and the contact portion are configured to move both towards the bottom portion and in a longitudinal direction of the insulating housing in response to pressure imposed on the contact portion.

21 Claims, 4 Drawing Sheets

(51) Int. Cl.

| | |
|---|---|
| ***H01R 13/03*** | (2006.01) |
| ***H01R 13/42*** | (2006.01) |
| ***H01R 13/46*** | (2006.01) |
| ***H01R 43/20*** | (2006.01) |
| ***H01R 13/50*** | (2006.01) |
| *H01R 12/57* | (2011.01) |

(52) U.S. Cl.
CPC ..... *H01R 13/42* (2013.01); *H01R 13/46* (2013.01); *H01R 13/50* (2013.01); *H01R 43/20* (2013.01); *H01R 12/57* (2013.01)

(58) Field of Classification Search
USPC ..... 439/862, 500
See application file for complete search history.

(56) References Cited

U.S. PATENT DOCUMENTS

| | | | | |
|---|---|---|---|---|
| 7,803,011 | B1 * | 9/2010 | Mai | H01R 13/2428 439/500 |
| 8,192,236 | B1 | 6/2012 | Zhu | |
| 2002/0048999 | A1 | 4/2002 | Ming-Hui | |
| 2011/0177726 | A1 | 7/2011 | Koyama et al. | |

FOREIGN PATENT DOCUMENTS

| | | | |
|---|---|---|---|
| CN | 201130749 | | 10/2008 |
| CN | 102185203 | A | 9/2011 |
| EP | 0810689 | B1 | 1/2002 |
| EP | 1965469 | A2 | 9/2008 |
| EP | 2093842 | A1 | 8/2009 |
| JP | 2002-319461 | A | 10/2002 |
| JP | 2004265598 | | 9/2004 |
| JP | 2004-311264 | A | 11/2004 |
| JP | 2005-183095 | A | 7/2005 |
| JP | 2006-164682 | A | 6/2006 |
| JP | 2008-198559 | A | 8/2008 |
| WO | 2004/055944 | A1 | 7/2004 |
| WO | 2006/057621 | A1 | 6/2006 |
| WO | 2007/060709 | A1 | 5/2007 |

OTHER PUBLICATIONS

Office action received for corresponding Chinese Patent Application No. 201380079457.X, dated Feb. 20, 2017, 7 pages of office action and 3 pages of translation available.
Office action received for corresponding Japanese Patent Application No. 2016-539382, dated Feb. 22, 2017, 4 pages of office action and 6 pages of translation available.
Extended European Search Report received for corresponding European Patent Application No. 13893007.8, dated Mar. 16, 2017, 7 pages.

* cited by examiner (a)

(b)

BATTERY CONNECTOR AND MANUFACTURING METHOD THEREFOR

RELATED APPLICATION

This application was originally filed as PCT Application No. PCT/CN2013/083150 filed Sep. 9, 2013.

FIELD OF THE INVENTION

Examples and non-limiting embodiments of this invention relate generally to a connector and more particularly to a battery connector and manufacturing method therefor.

BACKGROUND OF THE INVENTION

A conventional battery connector used in a mobile phone or other portable electronic devices includes an insulating housing defining a plurality of terminal recesses therein, and a plurality of conductive terminals disposed in respective terminal recesses. Each of the conductive terminals has a base board received in the corresponding terminal recess. An edge of the base board crookedly extends forward to form an elastic portion received in the corresponding terminal recess. A free end of the elastic portion extends forward to form a contact portion stretching out of the insulating housing for contacting a corresponding battery. When the battery connector is in use, the contact portion is pushed by the battery that makes the elastic portion compressed elastically towards the corresponding terminal recess.

SUMMARY OF THE INVENTION

Example embodiments of the present invention propose a new design of a battery connector for providing a longer wiping distance and thus improving electrical reliability.

An aspect of the present invention relates to a battery connector. The battery connector comprises an insulating housing defining a plurality of isolated terminal chambers, each of the terminal chambers having a bottom portion on one side of the insulating housing and an opening through a surface on the opposite side of the insulating housing. The battery connector further comprises a plurality of conductive terminals disposed in respective terminal chambers of the insulating housing, wherein each of the conductive terminals comprises: a fixing portion that is fixed on the bottom portion of a corresponding terminal chamber; a contact portion that is projecting out of the opening; and a middle portion that is connected between the fixing portion and the contact portion and slanting from one end of the fixing portion towards the other end of the fixing portion, and wherein the middle portion and the contact portion are configured to move both towards the bottom portion and in a longitudinal direction of the insulating housing in response to pressure imposed on the contact portion.

A second aspect of the present invention relates to a method for manufacturing a battery connector according to the first aspect of the present invention. The method comprises: forming the plurality of conductive terminals; and forming the insulating housing with the plurality of conductive terminals being disposed in the plurality of isolated terminal chambers defined within the insulating housing by an insert molding process such that the fixing portion is fixed on the bottom portion of the corresponding terminal chamber; the contact portion is projecting out of the opening; and the middle portion and the contact portion are moved both towards the bottom portion and in a longitudinal direction of the insulating housing in response to pressure imposed on the contact portion.

A third aspect of the present invention relates to a method for manufacturing a battery connector according to the first aspect of the present invention. The method comprises: forming the insulating housing and the plurality of conductive terminals separately, wherein the fixing portion of each of the conductive terminals is formed to be larger in size than the bottom portion of the corresponding terminal chamber; and mounting the plurality of conductive terminals into the insulating housing by a interfering fit process such that the fixing portion is fixed on the bottom portion of the corresponding terminal chamber; the contact portion is projecting out of the opening; and the middle portion and the contact portion are moved both towards the bottom portion and in a longitudinal direction of the insulating housing in response to pressure imposed on the contact portion.

BRIEF DESCRIPTION OF DRAWINGS

The invention itself, preferable modes of use and further objectives are best understood by reference to the following detailed description of the embodiments when read in conjunction with the accompanying drawings, wherein like reference numerals generally refer to like elements in the embodiments of the present disclosure.

DETAILED DESCRIPTION OF EMBODIMENTS

Some preferable embodiments will be described in more detail with reference to the accompanying drawings, in which the preferable embodiments of the present disclosure have been illustrated. However, the present disclosure can be implemented in various manners, and thus should not be construed to be limited to the embodiments disclosed herein. On the contrary, those embodiments are provided for thorough and complete understanding of the present disclosure, and completely conveying the scope of the present disclosure to those skilled in the art.

Hereinafter, various embodiments and implementations of the present invention and its aspects are described using several alternatives. It is generally noted that, according to certain needs and constraints, all of the described alternatives may be provided alone or in any conceivable combination (also including combinations of individual features of the various alternatives).

Dirt or oxide on the surface of the contract portion of a conductive terminal may impact electrical conductivity of a battery connector. Wiping distance is a parameter in the design of a battery connector and is defined herein as a horizontal displacement of the top of the contact portion from a free state with no pressure being imposed to a compressed state when being pressed by a battery. Wiping distance may affect the electrical reliability of the connector. A longer wiping distance may be beneficial since the longer wiping distance tends to insure the effect of dirt or oxide cleaning and adapt to manufacturing tolerances. However, the conventional connector can not offer a sufficient wiping distance to optimize the electrical performance of the connector.

Figure 1:
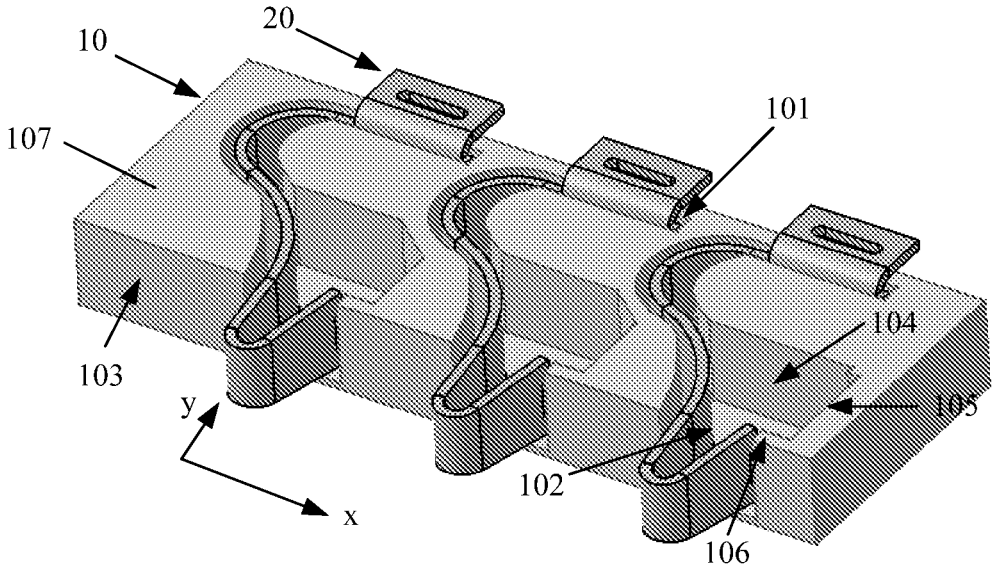
FIG. 1 is an exemplary diagram illustrating a battery connector according to an embodiment of the present invention.

Reference is first made to FIG. 1, in which a battery connector according to an embodiment of the present invention is illustrated. The battery connector includes an insulating housing 10 and a plurality of conductive terminals 20 disposed in the insulating housing 10. The number of conductive terminals 20 may be three, as shown in FIG. 1, but embodiments may comprise also a different number of connectors, for example two or four connectors.

As illustrated in FIG. 1, the insulating housing 10 is of a cuboid shape and includes a plurality of terminal chambers. The terminal chambers may be arranged at regular intervals along a longitudinal direction thereof (i.e. x direction as shown in FIG. 1). The insulating housing 10 can be made of an insulating material, including but not limited to Nylon or Liquid Crystal Polymer (LCP). The terminal chambers are sufficiently insulated by the insulating material such that the resistance between any two adjacent terminal chambers can be more than 1000 MΩ.

Each of the terminal chambers comprises a bottom portion 101 on the rear side of the insulating housing 10, and an opening 102 through a surface 103 on the front side of the insulating housing 10. The middle portion between the bottom portion 101 and the opening 102 of each terminal chamber defines a space 104 for accommodating the movement of the conductive terminal 20. Space 104 may allow at least part of the conductive terminal 20 to move in the longitudinal direction, for example, towards another conductive terminal. In FIG. 1, the middle portion of the terminal chamber is illustrated to be serpentine on the left side and rectangular on the right side. However, a person skilled in the art shall note that the terminal chamber can be of any shape, as long as it can accommodate the movement of the conductive terminal and the intermediate part between two adjacent terminal chambers can sufficiently insulate the corresponding conductive terminals disposed therein.

The right side wall 105 of the accommodating space 104 as shown in FIG. 1 is formed with a step 106 that causes the width of the opening 102 is less than the width of the accommodating space 104. The step 106 serves as a stopping portion with a certain thickness so as to restrain a propping portion (which will be detailed later) of the conductive terminal from moving out of the terminal chamber.

Figure 2:
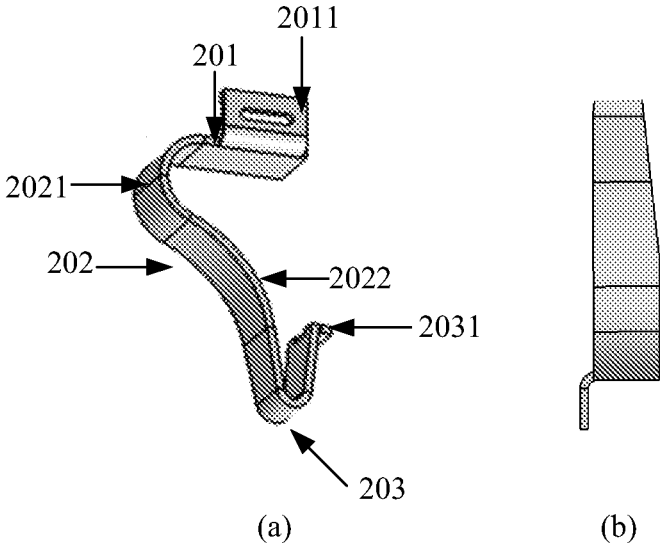
FIG. 2 is an exemplary diagram illustrating a conductive terminal 20 according to an embodiment of the present invention.

Now referring to FIG. 2, a conductive terminal 20 according to an embodiment of the present invention is illustrated. In this embodiment, the conductive terminal 20 includes a fixing portion 201, a contact portion 203 and a middle portion 202 that is connected between the fixing portion 201 and the contact portion 203 and slanting from one end of the fixing portion 201 towards the other end of it, e.g. from the left end to the right end as shown in FIG. 2 (*a*). In this embodiment, the middle portion 202 of the conductive terminal 20 comprises a first bending part 2021 connected to the fixing portion 201, which is configured for releasing stress when the conductive terminal is compressed. Preferably, the middle portion 202 may further comprise a second bending part 2022 connected to the contact portion 203 and configured for limiting the contact portion 203 from moving too far to contact with the effective area of a battery pad. Preferably, the bending radius of the first bending part 2021 is smaller than that of the second bending part 2022. The first bending part 2021 is bent in a bending direction different from the bending direction of the second bending part 2022. Preferably, the width of the first bending part 2021 is wider than that of the second bending part 2022 and the second bending part 2022 is tapered from the first bending part 2021 towards the contact portion 203, as shown in FIG. 2 (*b*).

In one embodiment, a top edge of the fixing portion 201 of the conductive terminal 20 extends upward and then is perpendicular bent outward to form a soldering part 2011 that may be soldered on a PCB board in a mobile phone when the battery connector is installed therein. The soldering part 2011 is preferably of a rectangular shape as shown in FIG. 2(*a*). However, it shall be understood that the shape of the soldering part 2011 is not limited to be rectangular. Any shape that can enable the soldering part 2011 to be firmly soldered on the PCB board is possible.

In this embodiment, the contact portion 203 is of a lying V-shape with an opening facing the fixing portion 201 when it is in a free state with no pressure being applied on the contact portion 203. The contact portion 203 of the conductive terminal 20 comprises a free end defining a propping part 2031. The propping part 2031 will be positioned on the stopping portion 106 when the conductive terminal is in the free state so as to avoid the free end of the contact portion 203 moving out of the terminal chamber and thus prevent the conductive terminal from damage by unintentional external forces.

Preferably, the contact portion 203 may be further shaped, for example by embedding one or more beads on the top of the contact portion, so as to make a point contact with the pad of a battery. Preferably, the top of the contact portion may also be plated with gold so as to improve the contact reliability.

Referring back to FIG. 1, in the assembled battery connector, the plurality of conductive terminals is disposed in corresponding terminal chambers. The fixing portion 201 of each conductive terminal 20 is fixed on the bottom portion 101 of the corresponding terminal chamber 10. The contact portion 203 is projecting out of the opening 102 for contacting a battery (not shown), for example, by means of the contact beads on the top of the contact portion. The propping portion 2031 is positioned on the corresponding stopping portion 106 for restraining the free end of the contact portion 203 from moving out of the accommodating space and thereby preventing the conductive terminal from damage by unintentional external forces. The soldering part 2011 is left outside of the insulating housing for being soldered on the PCB board in a mobile phone or portable devices.

In use, the contact portion 203 is pushed by a battery that causes the middle portion 202 and the contact portion 203 to move both towards the bottom portion 101 and in a longitudinal direction (i.e. x direction as shown in FIG. 1). In this case, the movement of the middle portion 202 and the contact portion 203 in the longitudinal direction improves the wiping distance. With the conductive terminal made of Titanium copper alloy C1990-1/2H, the wiping distance can be up to 1.6 mm. When the battery is taken away from the battery connector, the elasticity of the middle portion 202 is set free to push the contact portion 203 to move outward until the propping portion 2031 is restrained.

Figure 3:
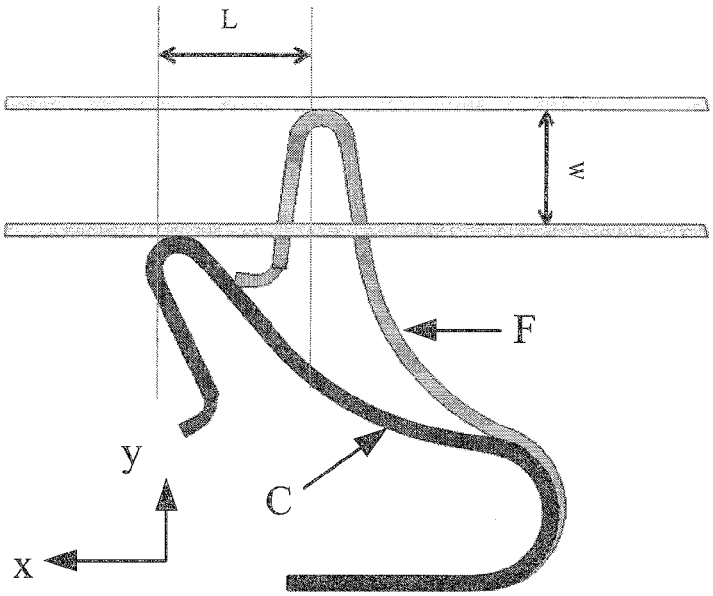
FIG. 3 illustrates working states of a conductive terminal 20 according to an embodiment of the present invention.
Figure 3:
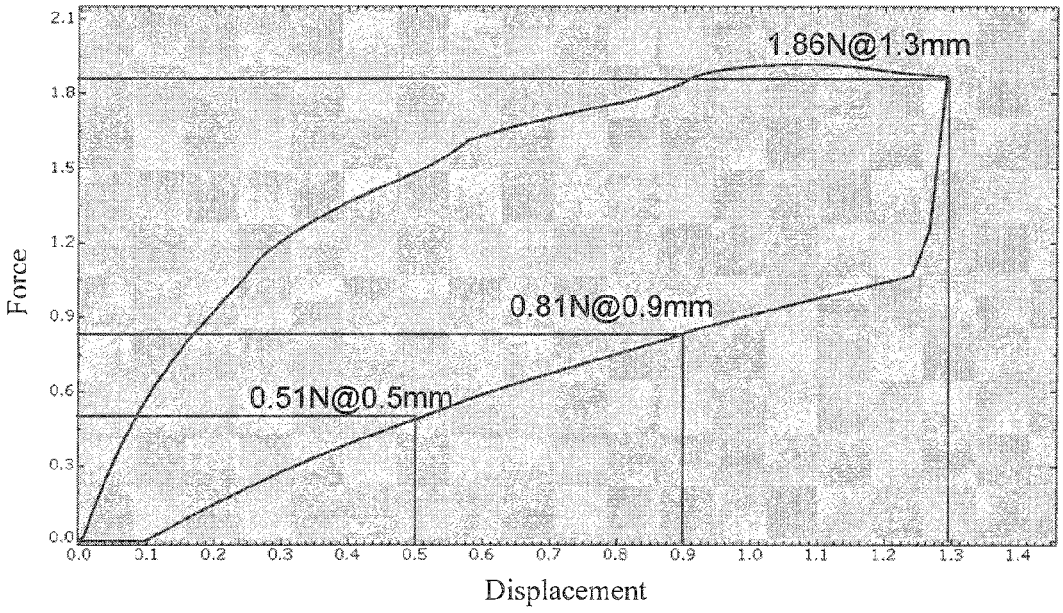

FIG. 3 illustrates working states of a conductive terminal 20 according to an embodiment of the present invention. The conductive terminal 20 is referred to be in a free state (denoted as "F" in FIG. 3 (*a*)) with no pressure being applied on the contact portion 203 of the conductive terminal 20, and otherwise referred to be in a compressed state (denoted as "C" in FIG. 3(*a*)) with a certain pressure being applied on the contact portion 203. FIG. 3(*a*) also shows the wiping distance and working range of a specific conductive terminal made of Titanium copper alloy C1990-1/2H according to an embodiment of the present invention. The maximum wiping distance L (i.e. the displacement in x direction) as shown in FIG. 3(*a*) is 1.6 mm and the working range W in vertical direction (i.e. the displacement in y direction) is 0.9+/−0.4 mm. FIG. 3(*b*) illustrates the simulated relation between normal forces applied on the contact portion 203 and the displacement of the contact portion in the vertical direction. The top curve shows the case when the battery connector is first pressed and the bottom curve shows the case when the pressure applied on the conductive terminal is released, which is also called a "return curve". It can be seen from this simulation result that all return curves of the specific conductive terminal coincide with each other.

Figure 4:
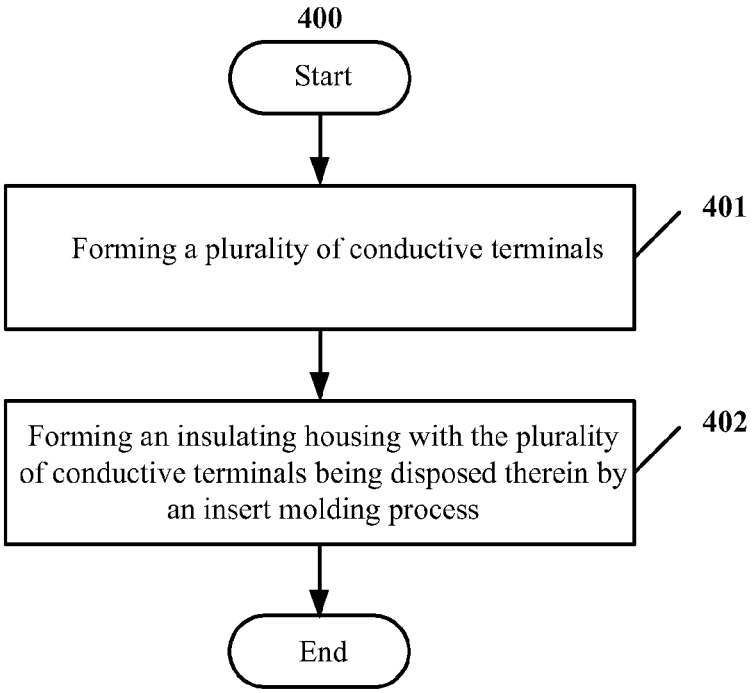
FIG. 4 illustrates a flowchart of a method 400 for manufacturing a battery connector according to embodiments of the present invention.

The battery connector according to embodiments of the present invention can be integration-molded into one piece, for example by an insert molding process. In FIG. 4, a method 400 for manufacturing a battery connector according to embodiments of the present invention is illustrated. In block 401, a plurality of conductive terminals is formed such that each of the conductive terminals comprises a fixing portion, a contact portion and a middle portion that is connected between the fixing portion and the contact portion and slanting from one end of the fixing portion towards the other end of the fixing portion; and in block 402 an insulating housing with the plurality of conductive terminals being disposed in a plurality of isolated terminal chambers defined within the insulating housing is formed, for example, by an insert molding process, such that: each of the terminal chambers comprises a bottom portion on one side of the insulating housing and an opening through a surface on the opposite side of the insulating housing; the fixing portion is fixed on the bottom portion of a corresponding terminal chamber; the contact portion is projecting out of the opening; and the middle portion and the contact portion are moved both towards the bottom portion and in a longitudinal direction of the insulating housing in response to pressure imposed on the contact portion.

Figure 5:
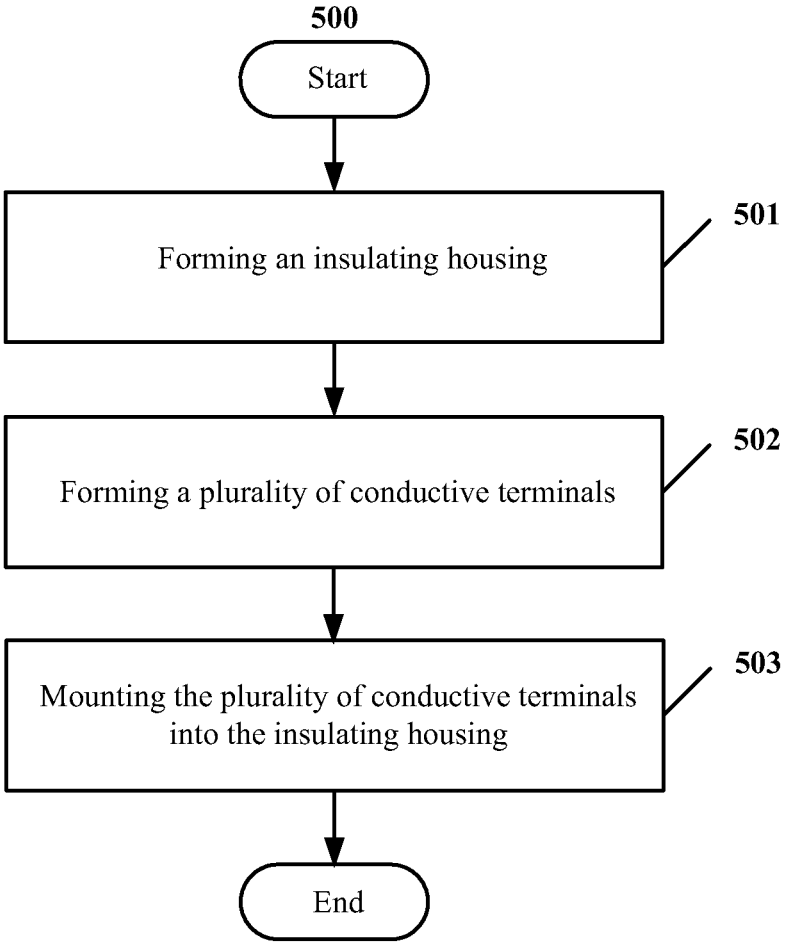
FIG. 5 illustrates a flowchart of a method 500 for manufacturing a battery connector according to embodiments of the present invention.

Alternatively, a battery connector according to embodiments of the present invention can be manufactured by mounting a plurality conductive terminals into an insulating housing, which are formed separately in advance, for example by a interfering fit process. In FIG. 5, a method 500 for manufacturing a battery connector according to embodiments of the present invention is illustrated. In block 501, an insulating housing defining a plurality of isolated terminal chambers is formed such that each of the terminal chambers comprises a bottom portion on one side of the insulating housing and an opening through a surface on the opposite side of the insulating housing, for example by a molding process; in block 502, a plurality of conductive terminals is formed such that each of the conductive terminals comprises a fixing portion, a contact portion and a middle portion that is connected between the fixing portion and the contact portion and slanting from one end of the fixing portion towards the other end of the fixing portion; and then in block 503, the plurality of conductive terminals is mounted into the insulating housing, for example by a interfering fit process with the size of the fixing portion of each conductive terminal being slightly larger than the bottom portion of the corresponding terminal chamber, such that: the fixing portion is fixed on the bottom portion of a corresponding terminal chamber; the contact portion is projecting out of the opening; and the middle portion and the contact portion are moved both towards the bottom portion and in a longitudinal direction of the insulating housing in response to pressure imposed on the contact portion. A person skilled in the art shall understand that the operations for manufacturing the battery connector are not necessarily performed in the same order as illustrated in FIG. 5. For example, the operation in block 501 and the operation in block 502 can be performed reversely or in parallel.

Exemplary embodiments of the present invention have been described above with reference to schematic diagrams and flowchart illustrations of methods. It will be understood that each block of the flowchart illustrations, and combinations of blocks in the flowchart illustrations, respectively, can be implemented by various means, not limited to any specific embodiment as disclosed.

Many modifications and other embodiments of the inventions set forth herein will come to mind to one skilled in the art to which these embodiments of the invention pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A connector, comprising:

a housing defining a plurality of isolated terminal chambers, each of the terminal chambers having a bottom portion on one side of the housing and an opening through a surface on another side of the housing; and a plurality of conductive terminals disposed in respective terminal chambers of the housing, wherein each of the conductive terminals comprises:

a fixing portion that is fixed on the bottom portion of a corresponding terminal chamber;

a contact portion that is projecting out of the opening; and a middle portion that is connected between the fixing portion and the contact portion and slanting from one end of the fixing portion towards the other end of the fixing portion, wherein the middle portion and the contact portion are configured to move both towards the bottom portion and in a longitudinal direction of the housing towards another conductive terminal in response to pressure imposed on the contact portion.

2. The connector according to claim 1, wherein the middle portion of each of the conductive terminals comprises at least a first bending part that is connected to the fixing portion of the corresponding conductive terminal.

3. The connector according to claim 2, wherein the middle portion of each of the conductive terminals further comprises a second bending part that is connected to the contact portion of the corresponding conductive terminal and bent in a bending direction different from the bending direction of the first bending part.

4. The connector according to claim 3, wherein a width of the first bending part is wider than the width of the second bending part; and the second bending part is tapered from the first bending part towards the contact portion.

5. The connector according to claim 1, wherein the fixing portion of each of the conductive terminals comprises a soldering part extending outside the housing from an edge of the fixing portion.

6. The connector according to claim 1, wherein the contact portion of each of the conductive terminals is made of a lying V-shape with an opening facing the fixing portion.

7. The connector according to claim 6, wherein the contact portion of each of the conductive terminals comprises a free end defining a propping part;

each of the terminal chambers defines a space for accommodating the movement of the middle portion and the contact portion of the corresponding conductive terminal; and a width of the opening through the surface is less than the width of the space such that a stopping portion is formed between the opening through the surface and the space to restrain the propping part.

8. The connector according to claim 1, wherein the housing is made of Nylon or Liquid Crystal Polymer (LCP) material; and the conductive terminals are made of one selected from a group consisting of titanium copper alloy, Cu—Ni—Si alloy and Phosphor bronze.

9. The connector according to claim 1, wherein the top of the contact portion is plated with gold.

10. The connector according to claim 1, wherein the contact portion is shaped to be in a point contact with an electrical pad of a battery.

11. A method, comprising:

providing a housing defining a plurality of isolated terminal chambers, each of the terminal chambers having a bottom portion on one side of the housing and an opening through a surface on another side of the housing; and disposing a plurality of conductive terminals in respective terminal chambers of the housing, wherein each of the conductive terminals comprises:

a fixing portion that is fixed on the bottom portion of a corresponding terminal chamber;

a contact portion that is projecting out of the opening; and a middle portion that is connected between the fixing portion and the contact portion and slanting from one end of the fixing portion towards the other end of the fixing portion, wherein the middle portion and the contact portion are configured to move both towards the bottom portion and in a longitudinal direction of the housing towards another conductive terminal in response to pressure imposed on the contact portion.

12. The method according to claim 11, wherein the middle portion of each of the conductive terminals comprises at least a first bending part that is connected to the fixing portion of the corresponding conductive terminal.

13. The method according to claim 12, wherein the middle portion of each of the conductive terminals further comprises a second bending part that is connected to the contact portion of the corresponding conductive terminal and bent in a bending direction different from the bending direction of the first bending part.

14. The method according to claim 13, wherein a width of the first bending part is wider than the width of the second bending part; and the second bending part is tapered from the first bending part towards the contact portion.

15. The method according to claim 11, wherein the fixing portion of each of the conductive terminals comprises a soldering part extending outside the housing from an edge of the fixing portion.

16. The method according to claim 11, further comprising:

forming the contact portion of each of the conductive terminals to be of a lying V-shape with an opening facing the fixing portion.

17. The method according to claim 16, wherein the contact portion of each of the conductive terminals comprises a free end defining a propping part;

each of the terminal chambers defines a space for accommodating the movement of the middle portion and the contact portion of the corresponding conductive terminal; and a width of the opening through the surface is less than the width of the space such that a stopping portion is formed between the opening through the surface and the space to restrain the propping part.

18. The method according to claim 11, further comprising:

forming the housing with Nylon or Liquid Crystal Polymer (LCP) material; and forming the conductive terminals with one selected from a group consisting of titanium copper alloy, Cu—Ni—Si alloy and Phosphor bronze.

19. The method according to claim 11, further comprising:

plating the top of the contact portion with gold.

20. The method according to claim 11, further comprising:

shaping the contact portion to be in a point contact with an electrical pad of a battery.

21. A device comprising a connector, the connector comprising:

a housing defining a plurality of isolated terminal chambers, each of the terminal chambers having a bottom portion on one side of the housing and an opening through a surface on another side of the housing; and a plurality of conductive terminals disposed in respective terminal chambers of the housing, wherein each of the conductive terminals comprises:

a fixing portion that is fixed on the bottom portion of a corresponding terminal chamber;

a contact portion that is projecting out of the opening; and a middle portion that is connected between the fixing portion and the contact portion and slanting from one end of the fixing portion towards the other end of the fixing portion, wherein the middle portion and the contact portion are configured to move both towards the bottom portion and in a longitudinal direction of the housing towards another conductive terminal in response to pressure imposed on the contact portion.

* * * * *